US005689275A

United States Patent [19]

Moore et al.

[11] Patent Number: 5,689,275

[45] Date of Patent: Nov. 18, 1997

[54] ELECTROMAGNETIC ANTENNA AND TRANSMISSION LINE UTILIZING PHOTONIC BANDGAP MATERIAL

[75] Inventors: Ricky Lamar Moore, Smyrna; Morris Philip Kesler, Douglasville; James Geoffrey Maloney; Brian Leon Shirley, both of Marietta, all of Ga.

[73] Assignee: Georgia Tech Research Corporation, Atlanta, Ga.

[21] Appl. No.: 442,482

[22] Filed: May 16, 1995

[51] Int. Cl.[6] ..... H01Q 13/00

[52] U.S. Cl. ..... 343/786; 343/772; 343/909

[58] Field of Search ..... 343/786, 909, 343/772, 784; H01Q 13/00

[56] References Cited

U.S. PATENT DOCUMENTS

| | | | |
|---|---|---|---|
| 4,632,517 | 12/1986 | Asher | 350/362 |
| 5,172,267 | 12/1992 | Yablonovitch | 359/515 |
| 5,187,461 | 2/1993 | Brommer et al. | 333/219.1 |
| 5,335,240 | 8/1994 | Ho et al. | 372/39 |
| 5,386,215 | 1/1995 | Brown | 343/795 |
| 5,389,943 | 2/1995 | Brommer et al. | 343/909 |
| 5,406,573 | 4/1995 | Ozbay et al. | 372/43 |
| 5,440,421 | 8/1995 | Fan et al. | 359/344 |
| 5,471,180 | 11/1995 | Brommer et al. | 343/909 |

OTHER PUBLICATIONS

Brown et al., "Photonic–Crystal Planar Antennas," APS News, vol. 2, No. 3, Mar. 1993, pp. 67–69.

Brown et al., "Radiation properties of a planar antenna on a photonic–crystal substrate," J. Opt. Soc. Am. B, vol. 10, No. 2, Feb. 1993, pp. 404–407.

Yablonovitch, "Photonic band–gap structures," J. Opt. Soc. Am. B, vol. 10, No. 2, Feb. 1993, pp. 283–295.

Ho et al., Comment on "Theory of Photon Bands in Three–Dimensional Periodic Dielectric Structures," Physical Review Letters, vol. 66, No. 3, Jan. 21, 1991, pp. 393–394.

Zhang et al., "Electromagnetic Wave Propagation in Periodic Structures: Bloch Wave Solution of Maxwell's Equations," Physical Review Letters, vol. 65, No. 21, Nov. 19, 1990, pp. 2650–2653.

Leung et al., "Full Vector Wave Calculation of Photonic Band Structures in Face–Centered–Cubic Dielectric Media," Physical Review Letters, vol. 65, No. 21, Nov.19, 1990, pp. 2646–2649.

Kato et al., "A 30 GHz MMIC Receiver for Satellite Transponders," IEEE Transactions on Microwave Theory and Techniques, vol. 38, No. 7, Jul. 1990, pp. 896–902.

Mongia, "Resonant Frequency of Cylindrical Dielectric Resonator Placed in an MIC Environment," IEEE Transactions on Microwave Theory and Techniques, vol. 38, No. 6, Jun. 1990, pp. 802–804.

Yablonovitch et al., "Photonic Band Structure: The Face–Centered–Cubic Case," Physical Review Letters, vol. 63, No. 18, Oct. 30, 1989, pp. 1950–1953.

John et al., "Optimcal structures for classical wave localization: An alternative to the Ioffe–Regel criterial," Physical Review B, vol. 38, No. 14, Nov. 15, 1988, pp. 10101–10104.

Yablonovitch, "Inhibited Spontaneous Emission in Solid–State Physics and Electronics," Physical Review Letters, vol. 58, No. 20, May 18, 1987, pp. 2059–2062.

*Primary Examiner*—Hoanganh T. Le

*Attorney, Agent, or Firm*—Thomas, Kayden, Horstemeyer & Risley

[57] ABSTRACT

A photonic bandgap antenna (PBA) (10') utilizes a periodic bandgap material (PBM), which is essentially a dielectric, to transmit, receive, or communicate electromagnetic radiation encoded with information. Further, a photonic bandgap transmission line (PBTL) (10") can also be constructed with the PBM. Because the PBA (10') and PBTL (10") do not utilize metal, the PBA (10') and PBTL (10") can be used in harsh environments, such as those characterized by high temperature and/or high pressure, and can be easily built into a dielectric structure such as a building wall or roof. Further, the PBA (10') and PBTL (10") inhibit scattering by incident electromagnetic radiation at frequencies outside those electromagnetic frequencies in the bandgap range associated with the PBM.

20 Claims, 7 Drawing Sheets

ELECTROMAGNETIC ANTENNA AND TRANSMISSION LINE UTILIZING PHOTONIC BANDGAP MATERIAL

FIELD OF THE INVENTION

The present invention generally relates to electromagnetic antennas and transmission lines, and more particularly, to a photonic bandgap antenna (PBA) and a photonic bandgap transmission line (PBTL), each of which utilizes a photonic bandgap (PBG) material (PBM) for transmitting, receiving, and/or communicating electromagnetic energy.

BACKGROUND OF THE INVENTION

The operation of an electromagnetic antenna (such as used in radar or communication systems) is described in numerous textbooks and references, such as that by Jasik, *Antenna Engineering Handbook* or Papas, *Theory of Electromagnetic Wave Propagation*. An antenna serves to transmit or receive electromagnetic waves as they propagate through a medium, such as air or free space. The operation of electromagnetic transmission lines are also described in numerous textbooks and references, such as that of Collin, *Foundations of Microwave Engineering* or Plonsey and Collin, *Principles and Applications of Electromagnetic Fields*. A transmission line, such as a microwave waveguide or stripline, confine, direct, and transmit the electromagnetic energy without radiating it through free space and thus may allow a source to be coupled to an antenna at a location remote from the source.

Antennas and transmission lines are typically made from electrically conducting materials, such as metals, including copper, brass, or aluminum. Antennas can be made to take a variety of geometrical configurations, depending in large part upon the wavelength(s) of energy communicated and the need to directionally transmit the energy. Thus a parabolic shaped antenna might be used to transmit a large percentage of energy in a specific direction or a wire might be used to transmit electromagnetic energy over a large angular sector. Similarly, electromagnetic transmission lines may be constructed in different geometrical shapes. A few examples are a cylindrical, rectangular, or ridged waveguide or a coaxial transmission line.

It also is desirable that antennas and electromagnetic transmission lines be robust in their resistance to harsh environments, including corrosive environments or environments with extreme temperatures and/or extreme pressures. Examples are as follows. Antennas must operate on space vehicles and must continue operation and endure extreme temperatures and pressures upon reentry of the space vehicle into the earth's atmosphere. Antennas and transmission lines may be used in subsurface well logging, particularly on oil and gas exploration equipment that must operate under caustic, high temperature, and high pressure conditions. In microwave sintering applications, such as in the manufacture of high purity ceramics or metals, antennas and transmission lines must operate very close to the material to be melted. Other environmentally demanding applications for antennas include radio frequency (RF) pumping processes in Tokamak reactors for hydrogen fusion, radio frequency sputtering processes, and plasma enhanced chemical vapor deposition (PECVD) processes.

As previously stated, the conductive metallic architecture of antennas can make them vulnerable to the aforementioned harsh environmental conditions since many metals having very high conductivities cannot withstand high temperatures nor corrosive environments where chemical reactions may reduce their electrical conductivity, thus making them inoperable. High temperatures, high pressures, and the presence of liquids, such as water, cause a breakdown and degradation in the metal structure. As a result, in these harsh environments, metal antennas eventually suffer severe damage and are thereby rendered nonfunctional.

Metallic antennas and transmission lines exhibit a high reflectivity (R) of electromagnetic energy at frequencies other than the electromagnetic frequencies at which they are intended to operate, i.e. exhibit out-of-band scattering. For example, a parabolic metallic reflector antenna has a surface power reflection coefficient near unity over the complete HF, VHF, UHF, microwave, and millimeter wave frequency region. Reflectivity may remain large even into the infrared and visual part of the electromagnetic spectrum. Thus, two metallic antennas which are designed to operate at different frequency bands may scatter electromagnetic energy from one another and thus interfere with each other's performance. For example, an X-band (nominally 8 to 12 Gigahertz, GHz) antenna could not be placed in front of an S-band (nominally 2–4 GHz) antenna without interfering with the S-band performance by blocking and scattering energy transmitted from the S-band antenna or scattering energy meant to be received by the S-band antenna.

The elimination or reduction of out-of-band electromagnetic scattering from antennas and transmission lines would be a great advantage for applications where scattering must be minimized. Attempts have been made to accomplish this reduction by using reflecting films made from metallic films which are etched to make periodic resonant surfaces, i.e. frequency selective surfaces (FSS); however, these surfaces still suffer from the aforementioned adverse effects resulting from their metallic composition and thus may not withstand environmental extremes. Further, these FSS surfaces are typically very thin films and thus are parasitic and may not contribute to the structural integrity of an antenna or transmission line.

SUMMARY OF THE INVENTION

Another object of the present invention is to overcome the environmental, electromagnetic scattering, and structural deficiencies and inadequacies of the prior art antennas and transmission lines as noted above and as generally known in the industry.

Another object of the present invention is to provide a durable antenna and/or transmission line which can operate within and withstand harsh corrosive environments, including those characterized by high temperature, high pressure, and/or the presence of liquids.

Another object of the present invention is to provide an antenna and/or transmission line which has little, if no, metal components.

Another object of the present invention is to provide an antenna and/or transmission line which has a substantially nonmetal geometrically-shaped structure for transmitting and/or receiving electromagnetic energy and which is efficient in operation.

Another object of the present invention is to provide an antenna and/or transmission line which is substantially nonmetal for transmitting and/or receiving electromagnetic energy and which can be incorporated directly within the structural makeup of a building, aircraft, spacecraft, ship, or other structure which would normally require the antenna to be a separately attached part.

Another object of the present invention is to provide an antenna and/or transmission line which is efficient in operation and which is substantially nonmetal but has reduced electromagnetic scattering or reflection at frequencies out-of-band, i.e. at frequencies other than the operating electromagnetic frequencies of the antenna and/or transmission line.

Another object of the present invention is to provide an antenna and/or transmission line which can operate within much higher temperature environments than metallic antennas.

Another object of the present invention is to provide an antenna and/or transmission line which are simple in design, inexpensive to manufacture, and reliable in operation.

Briefly described, the present invention provides for a novel photonic bandgap antenna (PBA) and a novel photonic bandgap transmission line (PBTL), each of which utilizes a photonic bandgap (PBG) material (PBM) for transmitting, receiving, communicating, and/or coupling electromagnetic energy, or waves.

The PBA has an antenna feed for communicating energy between the PBA and support circuitry dedicated to reception and/or transmission processing. The antenna feed for the antenna can be any element for communicating energy between the PBA and the support circuitry, and when in the transmission mode, for exciting the antenna. For instance, the feed could be an open-ended waveguide, an electrical element (e.g., a dipole), or a periodic bandgap (PBG) material (PBM), or some other interface mechanism or medium.

In accordance with a significant feature of the present invention, the PBA is made of PBM, which exhibits a photonic bandgap (PBG) and which transmits and/or receives electromagnetic energy. The PBM can be, for example but not limited to, a plastic or ceramic, and thus, the PBA can be shaped, constructed, or configured in many typical antenna geometries and configurations, such as paraboloidal, spherical, reflecting plates, elliptical horn, or pyramidal horn, for transmitting and/or receiving electromagnetic energy.

Furthermore, the PBA may be formed in a two-dimensional (2D) configuration or a three-dimensional (3D) configuration. As an example, the PBA could be made in the shape of a 2D horn antenna with a V-shaped cross sectional channel for coupling the electromagnetic energy. In the foregoing configuration, the PBA is made using PBM that has a dielectric permittivity $\epsilon$ that varies periodically in two dimensions in order to achieve the desired functionality. As other examples, the PBA could be formed in a three dimensional (3D) configuration, such as in the shape of a 3D horn (e.g., circular, pyramidal, etc.), or a dish reflector antenna. In the latter configurations, the PBA is made from a material which has a periodically varying dielectric permittivity in each of three dimensions in order to achieve the desired functionality.

In accordance with another embodiment of the present invention, a transmission line can be constructed from PBM and is referred to herein as a photonic bandgap transmission line (PBTL). As with the PBA, the PBTL can be made of a plastic or ceramic, and thus, the PBTL can be shaped, constructed, or configured in many geometries and configurations. Moreover, the PBTL can exhibit 2D as well as 3D configurations, as previously described.

In addition to achieving all of the aforementioned objects, the PBA and PBTL of the present invention have numerous other advantages, a few of which are delineated hereafter.

An advantage of the PBA is that it may be employed on a space vehicle without the need for a ceramic cover, i.e., a radome, which has previously been employed for shielding space vehicle antennas. For this application, the PBM which makes the PBA or the PBTL could be assembled from non-conducting temperature-resistant ceramics, such as silica ($SiO_2$) or silicon nitride (SiN).

Another advantage of the present invention is that the PBA can be communicated with via waveguides formed from standard metallic or PBM (to make a PBTL). In the context of a space vehicle, this configuration would allow the receiver/source and processing elements of the radar to be placed away from the space vehicle's leading edge, where the PBA is placed. All receiving and processing elements are thus placed within the protection of the space craft body.

Another advantage of the present invention is that the PBA or PBTL have minimal electromagnetic scattering at frequencies away from the operating bands of PBA or PBTL. In other words, the PBA or PBTL, which are without substantially any metal components, do not generate electromagnetic reflections resulting from incident electromagnetic radiation at frequencies which are not in the photonic bandgap. This feature makes the novel PBA or PBTL useful in reducing scattering to another antenna transmitting at frequencies out of the photonic bandgap. Further, other electrical transmitting or receiving systems within the vicinity of the novel PBA or PBTL are not adversely affected by stray reflected radiation, or electromagnetic interference (EMI).

Another advantage of the present invention is that the PBA or PBTL may be formed as an integral part of a mechanical structure. As a result, dielectric struts may be disposed in a desired periodic manner. In fact, the PBA may be formed, for example, within the structure of an aircraft, building, or other body so the antenna becomes a part of the load bearing structure and electromagnetic energy is transmitted from and/or received via a PBA which is part of the surrounding structural surface.

Another advantage of the present invention is that a cooling liquid may be circulated over or within periodically placed channels and voids which are used to make the PBM that is used to shape a PBA or PBTL. The liquid may be used to cool the structure and thus improve performance in extreme temperature environments. Further, by alternating cooling liquids with differing dielectric properties, the operational band of the PBA or PBTL may be varied because the use of differing dielectric fluids will change the frequency band at which the photonic bandgap appears. This feature is unlike the case with metal antennas where a cooling liquid in general inhibits antenna performance and may corrode and degrade the structure.

Another advantage of the present invention is that the PBA or PBTL can be made from widely available and inexpensive electrically lossless as well as somewhat lossy materials, for example but not limited to, pyrex, alumina ($Al_2O_3$) sapphire, silica ($SiO_2$), epoxy, and titanium oxide ($TiO_2$).

Other objects, features, and advantages of the present invention will become apparent to one with skill in the art upon examination of the following drawings and detailed description. All such additional objects, features, and advantages are intended to be included herein within the scope of the present invention, as is defined in the appended claims.

BRIEF DESCRIPTION OF THE DRAWINGS

The present invention can be better understood with reference to the following drawings. The drawings are not necessarily to scale, emphasis instead being placed upon clearly illustrating principles of the present invention. Further, in the drawings, like reference numerals designate corresponding parts throughout the several views.

FIG. 8A shows a perspective view, and FIG. 8B shows a cross-section of the perspective view in FIG. 8A taken along line 8B'—8B'.

DETAILED DESCRIPTION OF THE PREFERRED EMBODIMENTS

Figure 1A:
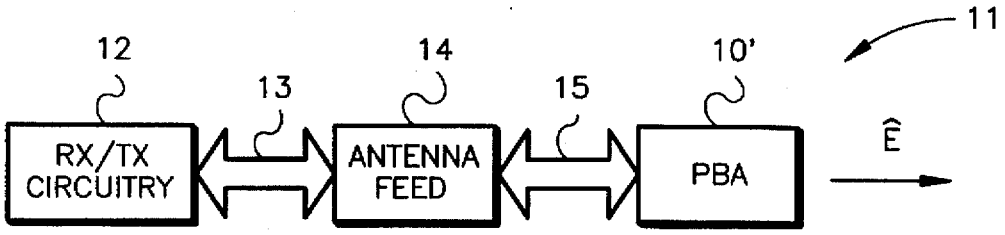
FIG. 1A is a high level block diagram illustrating a photonic bandgap antenna (PBA) system and method of the present invention wherein a photonic bandgap material (PBM) is utilized to construct the PBA of the system for coupling electromagnetic energy.
Figure 1B:
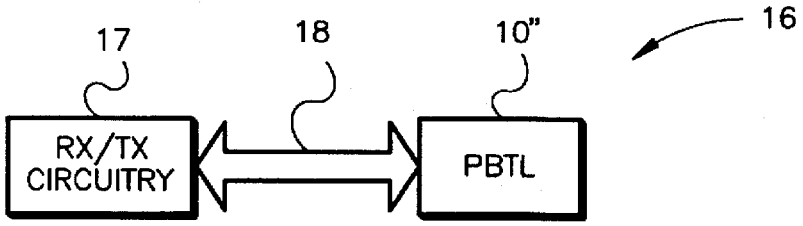
FIG. 1B is a high level block diagram illustrating a photonic bandgap transmission line (PBTL) system and method of the present invention wherein a PBM is utilized to construct the transmission line of the system for communicating electromagnetic energy.

The present invention provides for a novel photonic bandgap antenna (PBA) 10', as illustrated in FIG. 1A, and a novel photonic bandgap transmission line (PBTL) 10", as illustrated in FIG. 1B. Significantly, each utilizes a photonic bandgap (PBG) material (PBM), which is generally a dielectric (e.g., plastic, ceramic, etc.), for transmitting, receiving, and/or communicating electromagnetic energy.

Photonic Bandgap Antenna (PBA)

With reference to FIG. 1A, a PBA system 11 comprises receive and/or transmit (RX/TX) circuitry 12 for providing electrical reception and/or transmission processing support respectively, an antenna feed connected to the RX/TX circuitry 12 as indicated by arrow 13, and a PBA 10' connected to the antenna feed 14, as indicated by arrow 15.

The RX/TX circuitry 12 is well known in the art and can take a variety of configurations. The RX/TX circuitry 12 may be any suitable receiver, transmitter, or transceiver. The antenna feed 14 communicates the propagating electromagnetic wave with frequencies in the photonic bandgap from the RX/TX circuitry 12 to the PBA 10' and/or vice versa. The antenna feed 14 may be any suitable connection mechanism, for example, a transmission line (e.g., coaxial cable, twin lead, etc.) for communicating electrical energy, a waveguide for communicating an electromagnetic wave, etc.

Figure 2A:
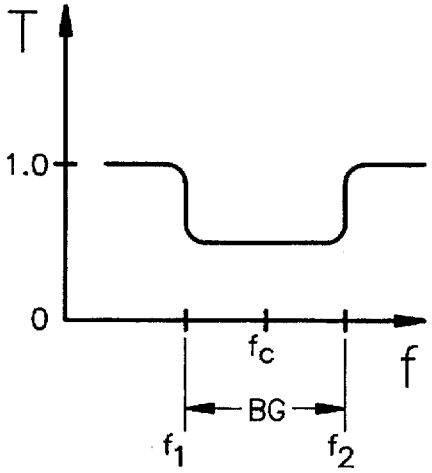
FIG. 2A is a graph illustrating transmissivity (T) versus frequency (f) typical for the PBM of FIG. 1.
Figure 2B:
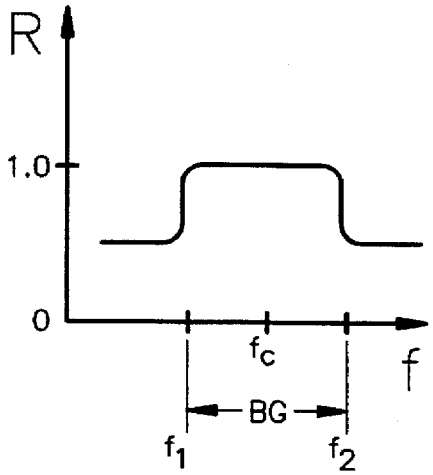
FIG. 2B is a graph illustrating reflectance (R) versus frequency (f) typical for the PBM of FIG. 1.

The PBA 10' is made from, or comprises, a photonic bandgap (PBG) material (PBM) in the present invention. A PBM, sometimes referred to as a photonic crystal in the art, is a dielectric structure that has periodic changes in dielectric composition (or dielectric permittivity) and that exhibits a transmissivity (T) and reflectivity (R), as shown in FIGS. 2A and 2B, respectively. Transmissivity (T) is the ratio of transmitted electric field strength $E_t$ to the incident electric field strength $E_i$, and reflectivity (R) is the ratio of reflected electric field strength $E_r$ to the incident electric field strength $E_i$. As is illustrated in FIG. 2A, the transmissivity curve exhibits a reduced transmissivity at electromagnetic frequencies within the bandgap BG between frequencies $f_1$ and $f_2$. In the bandgap BG, the reflectivity is near unity ("1.0"), as illustrated in FIG. 2B. It has been known that in the bandgap BG, the PBM exhibits a high reflectivity to electromagnetic energy at frequencies within the bandgap BG and low reflectivity at frequencies away from the bandgap BG. After extensive research by the inventors herein, it was determined that at frequencies in the bandgap BG, the PBM can be operable as a PBA 10' for transmitting or receiving electromagnetic energy encoded with information. In a sense, the antenna shaped PBM acts like a metal antenna within the bandgap BG and acts like a dielectric material outside of the bandgap BG.

Photonic Bandgap Transmission Line (PBTL)

Referring to FIG. 1B, a photonic bandgap transmission line (PBTL) system 16 comprises receive and/or transmit (RX/TX) circuitry 17 for providing electrical reception and/or transmission processing support, respectively, and the PBTL 10" connected to the circuitry 17, as indicated by arrow 18. Just as the PBA 10', the PBTL of FIG. 1B is made from, or comprises in substantial part, a PBM. Further, the PBM exhibits a bandgap BG, transmissivity (T), and reflectivity (R), as shown in FIGS. 2A and 2B.

The RX/TX circuitry 17 of FIG. 1B is well known in the art and can take a variety of configurations. The RX/TX circuitry 12 may be any suitable receiver, transmitter, or transceiver. The PBTL 10" communicates electromagnetic waves with frequencies in the photonic bandgap to and/or from the RX/TX circuitry 17.

It should be further noted that the PBA 10' of FIG. 1A may be implemented in a particular embodiment via a PBM. Hence, in this configuration, the combination of the RX/TX circuitry 12 and antenna feed 14, both of FIG. 1A, is analogous to the combination of the RX/TX circuitry 18 and PBTL 10", both of FIG. 1B.

Periodic Bandgap Material

Figure 3:
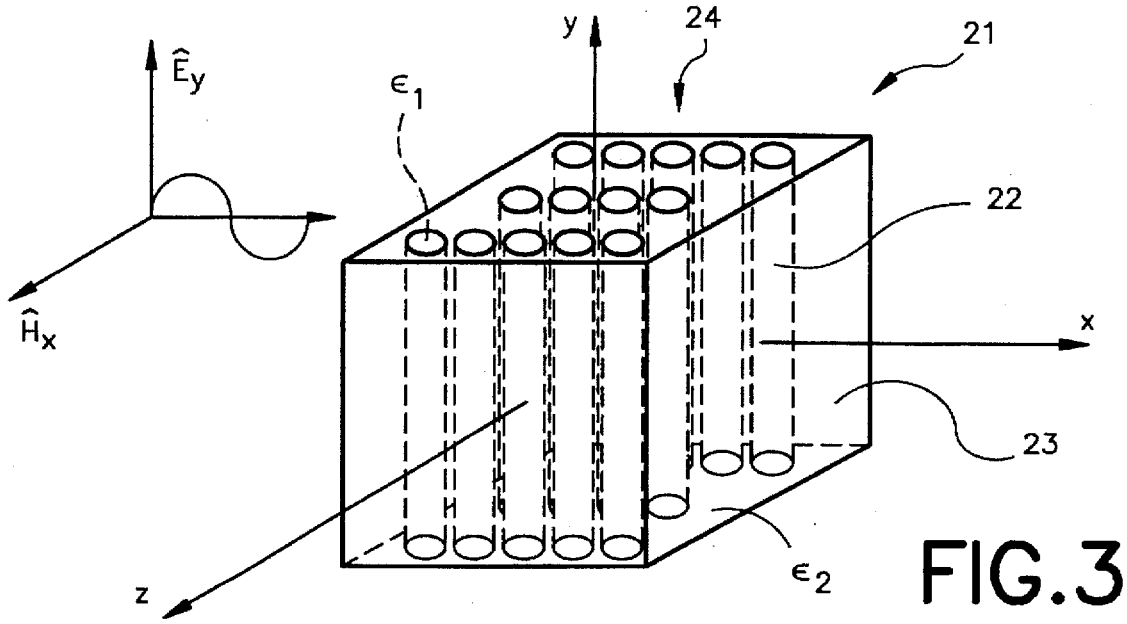
FIG. 3 is a perspective view of an example of a PBM that is periodic in two dimensions for use as the PBA of FIG. 1.
Figure 4:
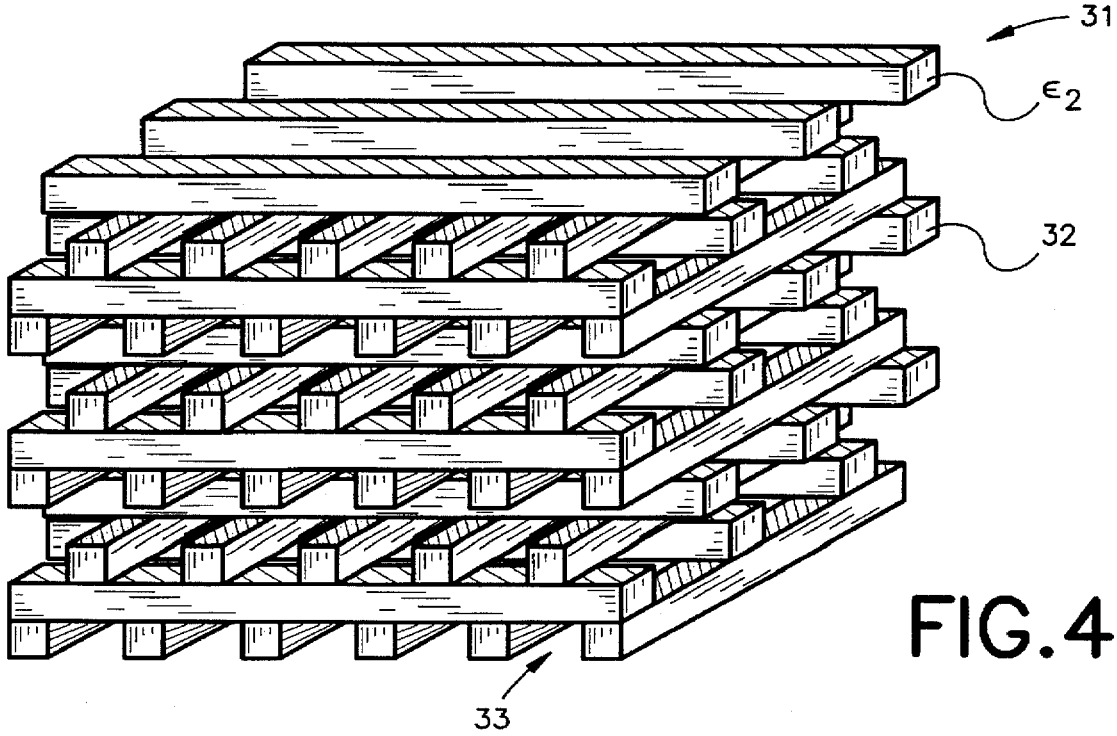
FIG. 4 is a perspective view of an example of a PBM that is periodic in three dimensions for use as the PBA of FIG. 1.

The PBM used to make the PBA 10' (FIG. 1A) and the PBTL 10" (FIG. 1B) will now be described in more detail hereafter. The PBM is characterized by a periodicity in dielectric properties in two dimensions or three dimensions. Periodicity refers to a repeated change in dielectric composition. As examples, FIG. 3 shows a PBM 21 that is periodic in two dimensions, and FIG. 4 shows a PBM 31 that is periodic in three dimensions. Both the PBM 21 and the PBM 31 can be utilized to form the PBA 10' (FIG. 1A) or the PBTL 10" (FIG. 1B).

With reference to FIG. 3, the 2D PBM 21 includes a plurality of parallel elongated cylindrical elements 22 situated in a material 23 and extending orthogonally to the direction in which electromagnetic radiation 25 is incident to the material 21. In general, electromagnetic radiation is coupled at any angle incident to the x-z plane, but is generally not in the direction along the y-axis, as will be further described hereinafter. The elongated cylindrical elements 22 and the material 23 are both dielectric materials, but in order to establish periodicity in the x-z plane, their corresponding dielectric characteristics (i.e., dielectric permittivity) are different. For example, the elements 22 may be formed from a dielectric material having a low permittivity $\in_1$, and at the same time, the material 23 may be formed from a dielectric material having a high permittivity $\in_2$, or vice versa. The elements 22 may be holes (perhaps filled with air or other gases), voids, fluids, or solids. Further, the material 23 may be a gas, fluid, or solid.

The 2D PBM 21 can be positioned to filter incoming electromagnetic energy 24 polarized along the y-axis, which extends parallel to the longitudinal axes of the elements 22. The 2D PBM 21 reflects substantially all the incident electromagnetic energy 24 having this polarity and having the frequency within the range of the bandgap BG (FIG. 2). More specifically, the electromagnetic energy within the frequency range of the bandgap BG and polarized along the longitudinal axes of the elements 22 is substantially prevented from propagating through the material 21. Thus, the material 21 operates as a band stop filter. The material 21 is most effective for electromagnetic energy propagating in any incident angle of the x-z plane. The material 21 maintains a substantially constant electromagnetic behavior over the bandgap frequency range for radiation propagating along any incident angle in this plane.

A further feature of the PBM 21 (as well as the 3D dielectric material 31 of FIG. 4) is that the center frequency $f_c$ of the bandgap BG, the bandwidth of the bandgap BG (i.e., the stop band), and the bandgap transmissivity T can be tailored for any frequency range in the microwave to ultraviolet bands (i.e., about $10^6$ to about $10^{15}$ Hz) during the fabrication of the structure. The transmissivity T of the bandgap BG is proportional to the number of rows of elements 22. Thus, the transmissivity can be decreased by providing additional rows. Moreover, the center frequency $f_c$ of the bandgap BG can be computed in accordance with the following equation:

$$f_c=[13.8(13/\mu\in)^{1/2}]/a\ GHz$$

where $\in$=dielectric permittivity of the substrate material, $\mu$=magnetic permeability of the substrate material, and a=triangular lattice constant which corresponds to the distance in centimeters between centers of adjacent elements 22. The location of the bandgap BG on the frequency scale is determined by the center frequency $f_c$. The size of the bandgap BG is determined by the radius of the cylindrical elements 22 and the triangular lattice constant associated therewith.

The 3D PBM 31 shown in FIG. 4 is described in detail in U.S. Pat. No. 5,335,240 to Ho et al., the disclosure of which is incorporated herein by reference. Generally, the 3D PBG material 31 is formed by a plurality of layers, each being formed by a plurality of rods 32 separated by a given spacing 33. The material of the rods 32 contrasts with the material between the rods to have a refractive index contrast of at least 2. The rods in each layer are arranged with their axes parallel and at a given spacing. Adjacent layers are rotated by 90°, such that the axes of the rods 32 in any given layer are perpendicular to the axes in its neighbor. Alternating layers, that is, successive layers of rods 32 having their axes parallel, such as the first and third layers, are offset such that the rods 32 of one are about at the midpoint between the rods 32 of the other. A 4-layer periodicity is thus produced, and successive layers are stacked to form a 3D structure which exhibits a bandgap BG.

It should be emphasized that the embodiments of FIGS. 3 and 4 are merely examples and that the PBA 10' (FIG. 1) can be implemented with any suitable PBM, either 2D or 3D. In fact, other suitable 3D embodiments are shown in FIGS. 2–4 of U.S. Pat. No. 5,335,240 to Ho et al.

2D PBG Horn Antenna

Figure 5:
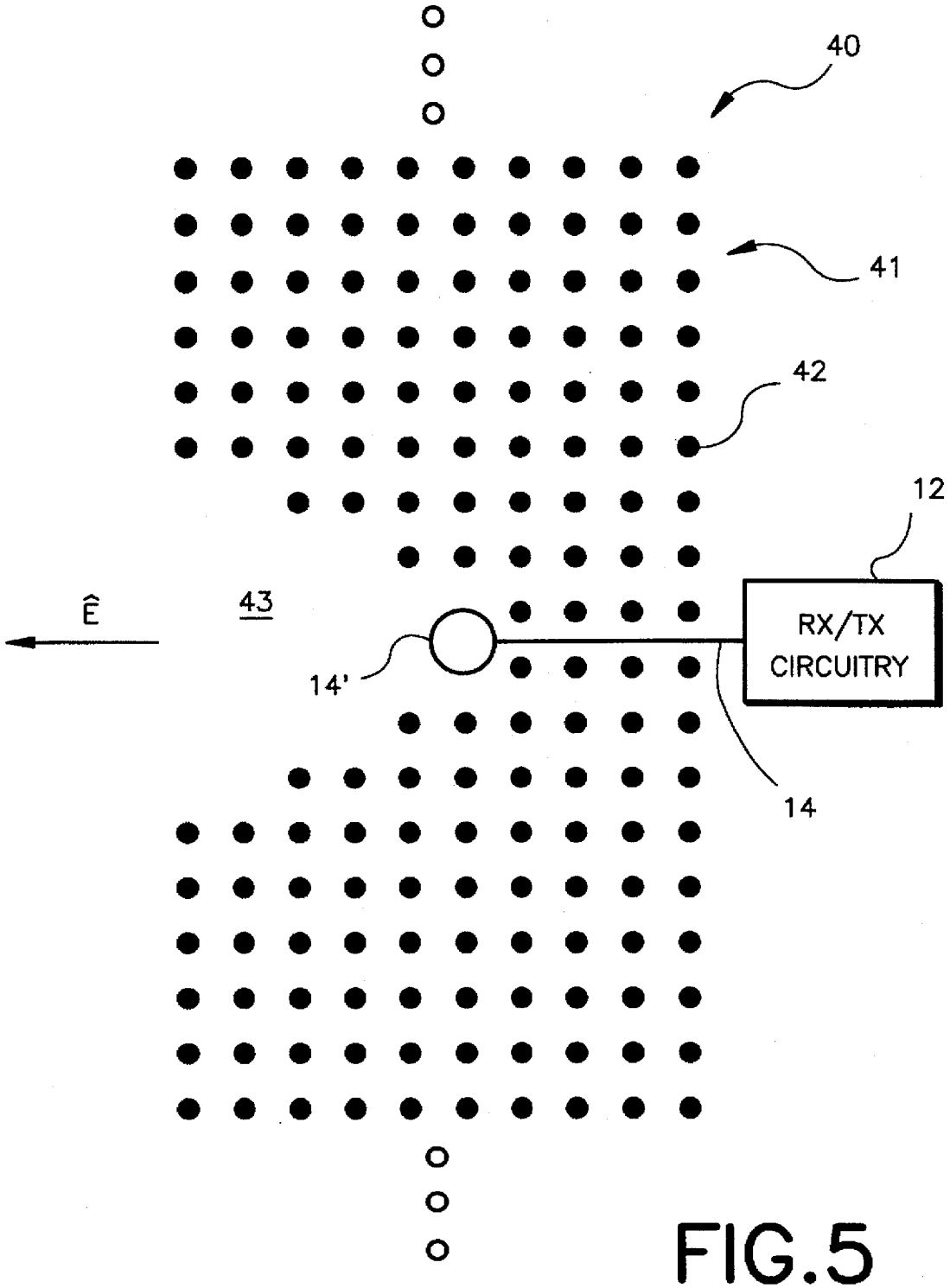
FIG. 5 is a cross sectional view of a 2D horn antenna system that has the PGM (periodic in two dimensions) of FIG. 3 and that was used in an experiment performed in support of the utility of the present invention.

To demonstrate the operability and utility of the present invention, a 2D PBG horn antenna system 40 having a 2D horn PBA 41 made of a PBM that is periodic in two dimensions and constructed as illustrated in FIG. 5. The 2D horn PBA 41 (or PBM) was constructed by suspending a grid, or matrix, of elongated cylindrical rods 42, shown in cross-section in FIG. 5, in air via a suitable support mechanism. The matrix of the PBM was fifty coles by ten rows of rods 42 and had a V-shaped channel 43 therein serving as the propagation source. The rods 42 measured approximately ¼ inch in diameter, were spaced apart by approximately ½ inch (about $\lambda/2$ apart), and had a dielectric permittivity $\in$ equal to about 4.2. Moreover, based upon the rod diameter, associated dielectric permittivity $\in$, spacing, and thickness, the bandgap BG associated with the PBM was determined to be between about 8 GHz ($f_1$) and about 10 GHz($f_2$) on the electromagnetic spectrum.

As further shown in FIG. 5, the 2D horn PBA 41 was excited in an anechoic chamber via transmit circuitry 12 and an antenna feed 14 connected thereto and passing within the V-shaped channel 43 of the PBM of 2D horn PBA 41. The feed 14 comprised a transmission line and a dipole probe 14', which excited the PBM of 2D horn PBA 41 and caused the material 41 to propagate electromagnetic radiation in the direction indicated by a reference arrow in FIG. 5.

Figure 6:
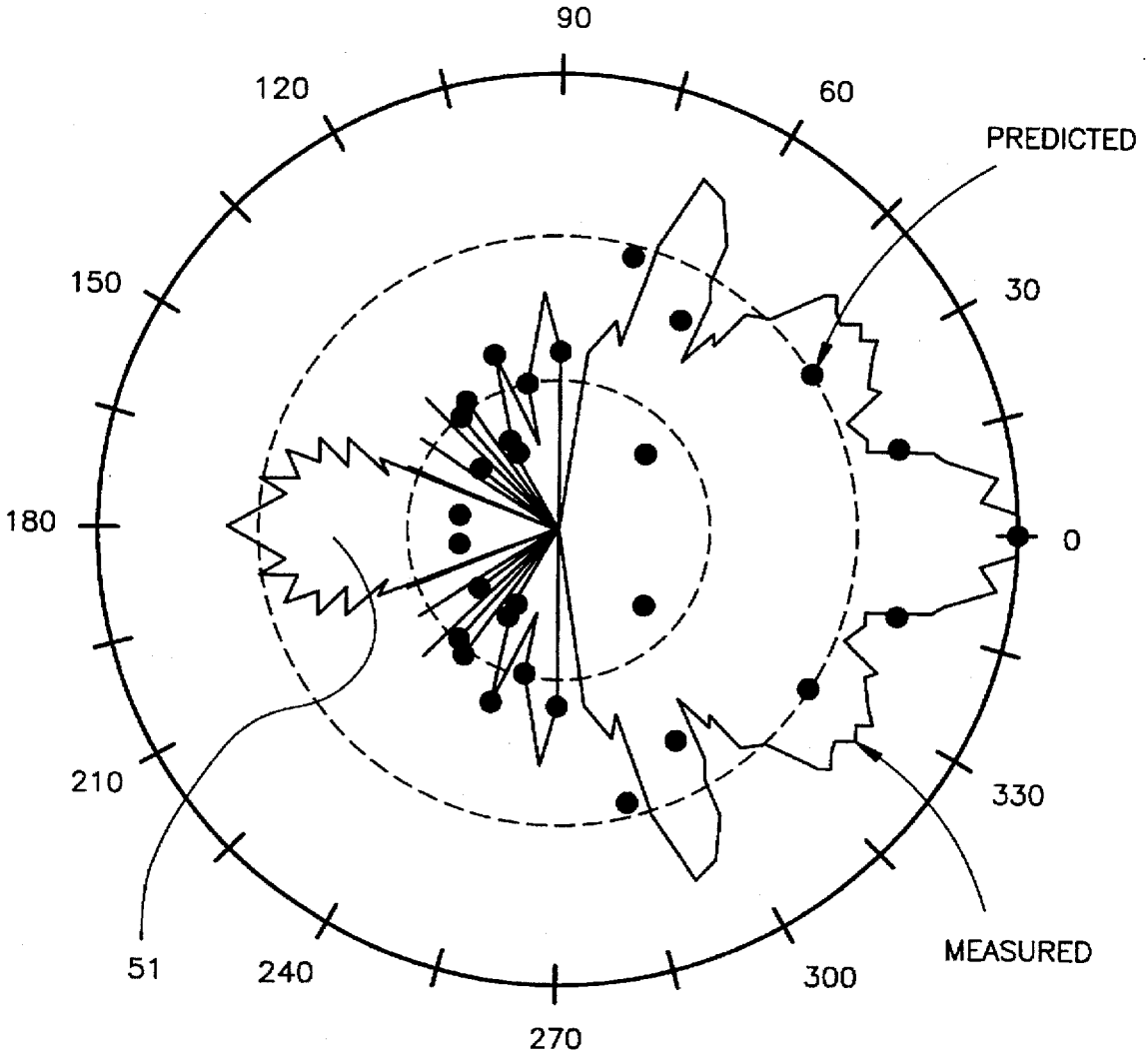
FIG. 6 is an electromagnetic radiation pattern corresponding with the 2D horn antenna system of FIG. 5.

FIG. 6 shows a radiation pattern which was measured from the 2D PBG horn antenna system 40 of FIG. 5. Measured data is indicated by solid lines, whereas predicted data is indicated by solid dots. As is illustrated in FIG. 6, the 2D PBG horn antenna system 40 exhibits an electromagnetic radiation pattern which substantially corresponds with that of a conventional metal horn antenna. Moreover, the back lobe 51 of the pattern may be minimized or eliminated by increasing the thickness behind the V-shaped channel 43 of the PBM of horn PBA 41.

Figure 8A:
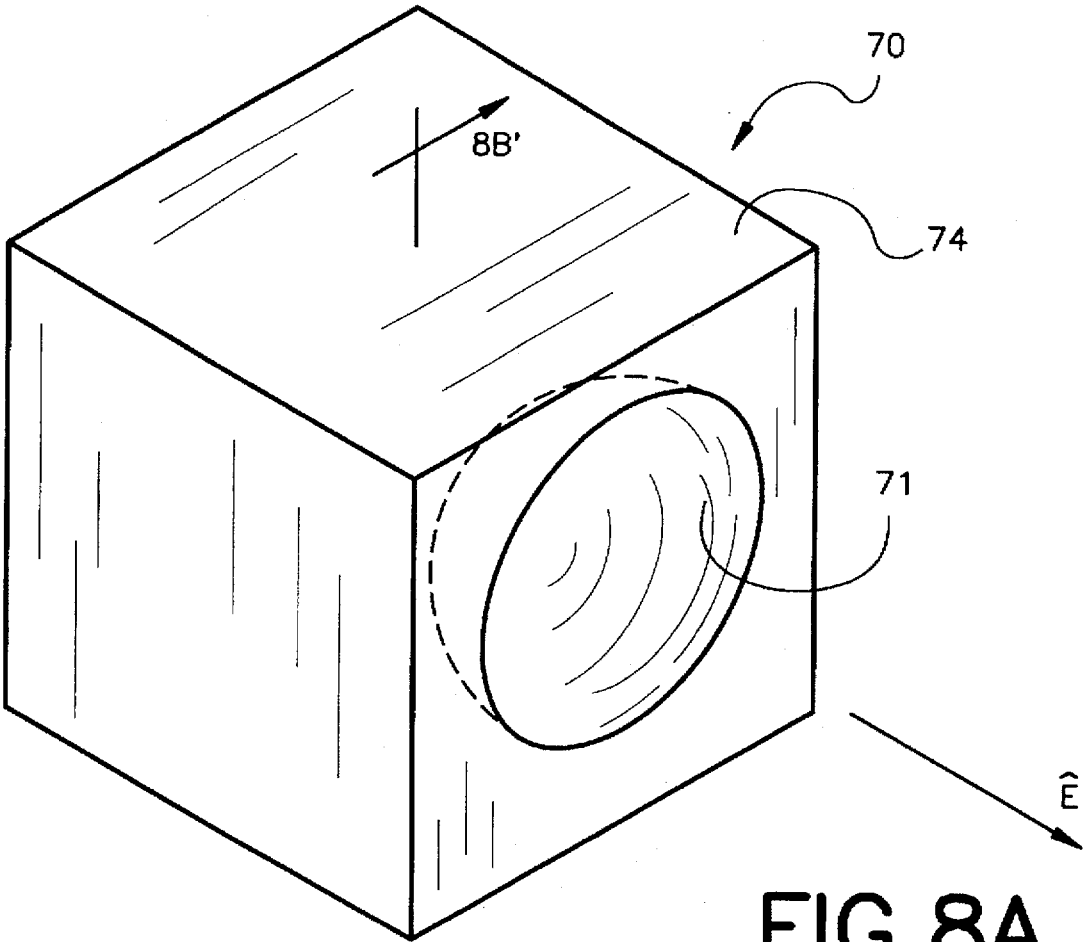
FIGS. 8A and 8B jointly illustrate a 3D dish antenna system employing the PBM (periodic in three dimensions) of FIG. 4; specifically.
Figure 8B:
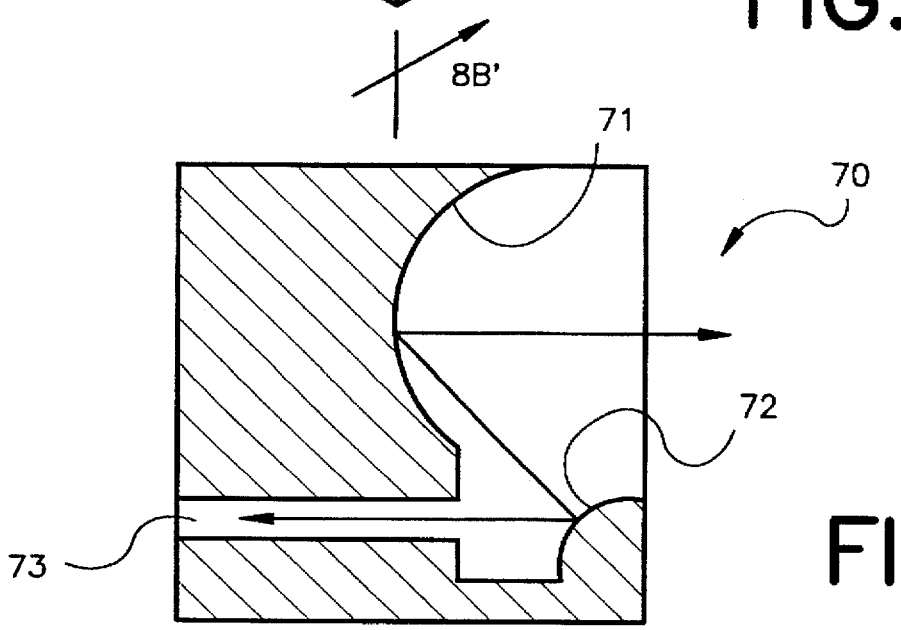
Figure 9:
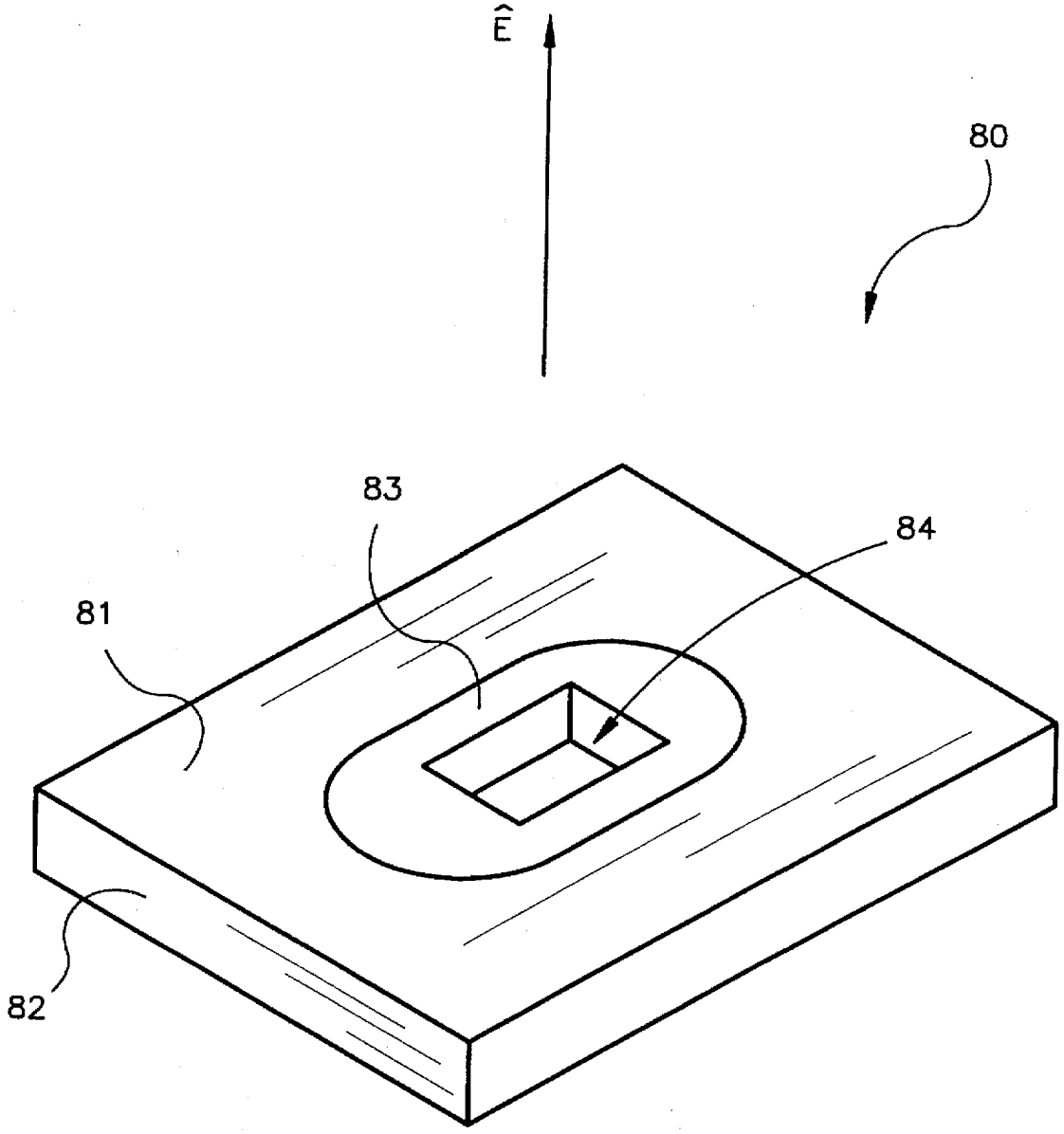
FIG. 9 is a perspective view of a 3D patch antenna system employing the PBM (periodic in three dimensions) of FIG. 4.

In addition to constructing antennas employing 2D PBG bodies, many embodiments are possible for implementing an antenna having a PBM that is periodic in three dimensions, or a 3D PBG antenna. As examples, FIG. 7 shows a 3D PBG pyramidal horn antenna system 60, FIGS. 8A and 8B show a 3D PBG dish antenna 70 and FIG. 9 shows a 3D PBG patch antenna 80.

3D PBG Horn Antenna

Figure 7:
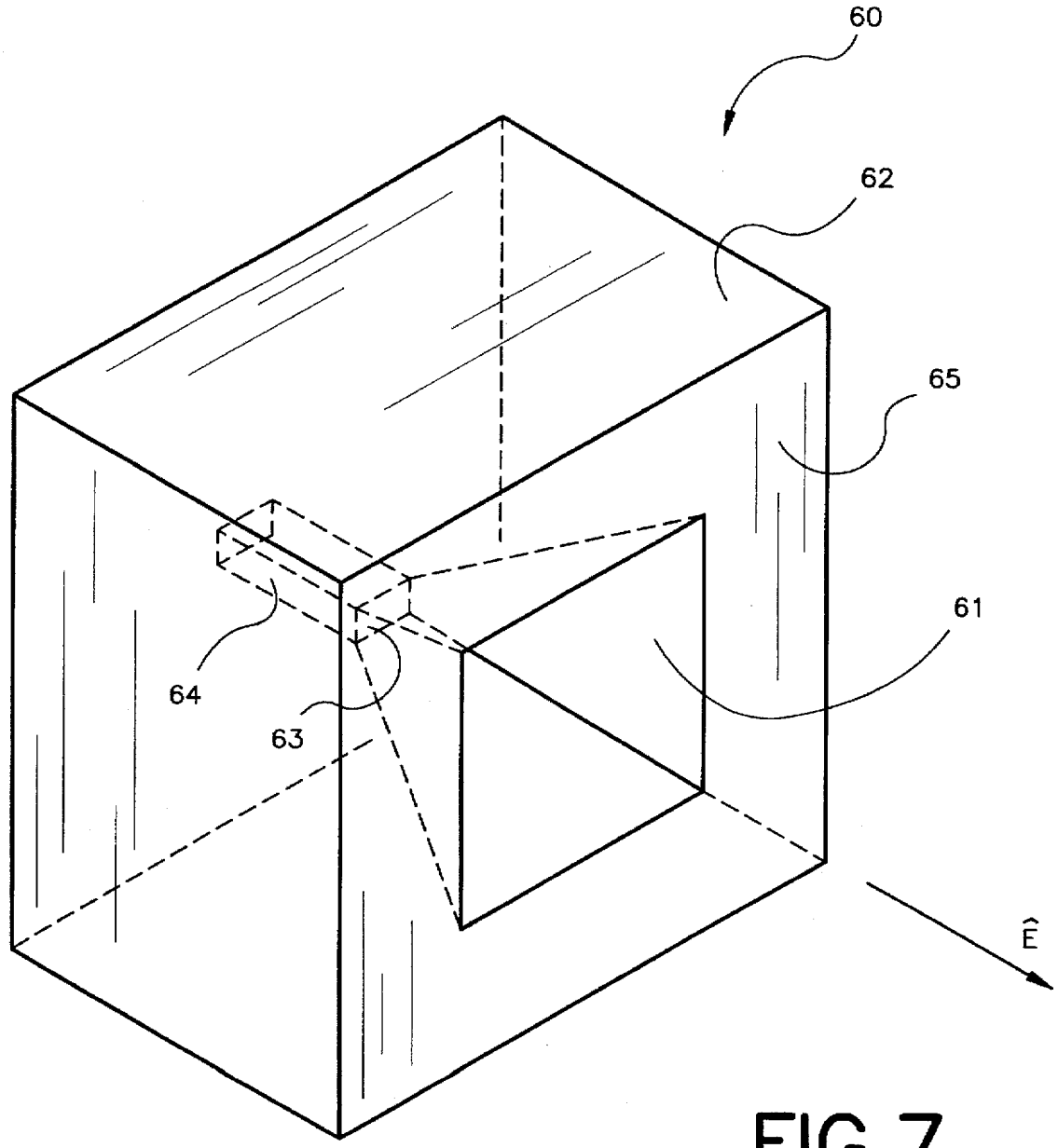
FIG. 7 is a perspective view of a 3D horn antenna system employing the PBM (periodic in three dimensions) of FIG. 4.

Referring to FIG. 7, the 3D PBG horn antenna system 60 comprises a 3D horn PBA 61, or horn aperture, which is disposed within a block 62 of a 3D PBM, for example but not limited to, that which is shown in and described relative to FIG. 4. The 3D horn PBA 61 has four sides in structure in this specific embodiment, but obviously, many other configurations are possible, such as a pyramidal horn having more or less sides or a conical horn. The 3D horn PBA 61 may be open to the propagation medium, or it may be filled with a material, which serves as an open throughway for the electromagnetic radiation, so that the surface 65 of the block 62 remains continuous. In other words, the 3D PBG horn antenna system 60 can be formed as an integral part of an existing mechanical structure.

The 3D horn PBA 61 is connected at its vertex 63 to a feed 64, which is in the form of a rectangular waveguide in this particular embodiment. The rectangular waveguide may have metallic walls or use the surrounding PBM, if desired. It should be further emphasized that the 3D horn PBA 61 may be excited or monitored via an electrical element situated at its vertex 63, for example, an antenna probe (e.g., a dipole), or some other suitable interface mechanism. Further, the feed 64 is preferably connected to an RX/TX circuitry 12 (FIG. 1).

Many mechanisms and techniques are known in the art for interfacing energy within the waveguide feed 64 with an electrical circuit, such as receive circuitry or transmit circuitry. Examples include a photodiode or a coaxial cable having its center conductor exposed in the waveguide channel. Further, many mechanisms and techniques are known for concurrently interfacing both transmit and receive circuitry with the waveguide feed 64 so as to implement a transceiver. An example is the well known "magic T" waveguide fitting.

3D PBG Dish Antenna

FIGS. 8A and 8B illustrate a 3D PBG dish antenna system 70 in accordance with the present invention. The 3D PBG dish antenna system 70 comprises a concave main reflector PBA 71 that serves as the radiating/receiving PBA 10' (FIG. 1), a subreflector 72, and a waveguide feed 73, all of which are formed within a block 74 of 3D PBM, for example but not limited to, that which is shown in and described relative to FIG. 4. The waveguide feed 73 is preferably connected to RX/TX circuitry 12 (FIG. 1) as previously described, relative to the horn antenna system 60 (FIG. 7).

The 3D PBG dish antenna system 70 may be open to the propagation medium, or it may be filled with a material, which serves as an open throughway for the electromagnetic radiation, so that the associated surface remains continuous. In other words, the 3D PBG dish antenna system 70 can be formed as an integral part of an existing mechanical structure. Furthermore, it should be noted that the waveguide feed 73 may have metallic walls or use the surrounding PBM, if desired, so that the feed 73 is analogous to the PBTL of FIG. 1B.

Operation of the dish antenna 80 is as follows. In a transmit mode, electromagnetic energy incident from the waveguide feed 73 strikes the subreflector 72 then travels toward the main reflector PBA 71, where it is collimated into the main beam. In a receive mode, an incident plane wave strikes the main reflector PBA 71, is redirected toward the subreflector 72, and is again redirected into the waveguide feed 73. Finally, just as with the 3D PBG horn antenna system 60 (FIG. 7), the 3D PBG dish antenna system 70 may be constructed as an integral part of a mechanical structure by filling the main reflector PBA 71 with a material which permits passage of electromagnetic energy operating at the appropriate carrier frequency.

3D PBG Patch Antenna

A novel planar patch antenna system 80 is illustrated in FIG. 9. The patch antenna system 80 is situated on a plane 81 of a substrate 82, which may for example be part of an integrated circuit. The patch antenna system 80 comprises a planar PBA 83 which is produced from a 3D PBM, such as that shown in and described relative to FIG. 4. The planar PBA 83 has an inside and outside periphery, as illustrated in FIG. 9, and transcends downwardly into the substrate 82 at a suitable depth, depending upon the desired operating frequency, radiation pattern, and other factors. Centrally located within the inside periphery of the planar PBA 83 is a waveguide feed 84. The waveguide feed 84 is interfaced with RX/TX circuitry 12 (FIG. 1A) as described previously. The patch antenna system 80 of FIG. 9 can propagate and/or receive electromagnetic energy to and/or from the surface 81 of the substrate 82. The patch antenna system 80 has all of the advantages of the previous embodiments, particularly the feature that propagation and reception of electromagnetic energy can be accomplished without the use of metal.

Furthermore, the 3D PBG patch antenna system 80 may be open to the propagation medium, or it may be filled with a material, which serves as an open throughway for the electromagnetic radiation, so that the associated surface 81 of the substrate 82 remains generally continuous. In other words, the 3D PBG patch antenna system 80 can be formed as an integral part of an existing mechanical structure. Furthermore, it should be noted that the waveguide feed 84 may utilize surrounding PBM, if desired, so that the feed 84 is analogous to the PBTL of FIG. 1B.

It will be obvious to those skilled in the art that many variations and modifications may be made to the described embodiments without substantially departing from the spirit and scope of the present invention. All such variations and modifications are intended to be included herein within the scope of the present invention, as set forth in the following claims.

Wherefore, the following is claimed:

1. An antenna comprising a photonic bandgap material that is adapted to transmit or receive electromagnetic waves encoded with information.

2. The antenna of claim 1, wherein said photonic bandgap material is periodic in two dimensions.

3. The antenna of claim 1, wherein said photonic bandgap material is periodic in three dimensions.

4. The antenna of claim 1, wherein said antenna is nonplanar.

5. The antenna of claim 1, wherein said antenna is planar.

6. The antenna of claim 1, wherein said antenna is concave.

7. The antenna of claim 1, further comprising an antenna feed which is made from a photonic bandgap material and which is connected to said antenna and adapted to communicate energy to or from said photonic bandgap material associated with said antenna.

8. The antenna of claim 1, further comprising a feed having a waveguide for interfacing energy with said photonic bandgap material.

9. The antenna of claim 1, further comprising a feed having a dipole for interfacing energy with said photonic bandgap material.

10. The antenna of claim 1, wherein said antenna is shaped like a horn.

11. The antenna of claim 1, wherein said antenna resides within a semiconductor substrate.

12. The antenna of claim 1, wherein said photonic bandgap material comprises a ceramic material.

13. A method, comprising the steps of:

communicating energy encoded with information to a photonic bandgap material; and transmitting electromagnetic radiation encoded with said information from said photonic bandgap material.

14. The method of claim 13, wherein said step of communicating includes the step of passing said energy through a waveguide to said photonic bandgap material.

15. The method of claim 13, wherein said step of communicating includes the step of passing said energy to said photonic bandgap material via a wire element.

16. The method of claim 13, wherein said photonic bandgap material is periodic in two dimensions.

17. The method of claim 13, wherein said photonic bandgap material is periodic in three dimensions.

18. The method of claim 13, wherein said photonic bandgap material has a wave interface surface which is nonplanar.

19. The method of claim 13, wherein said photonic bandgap material has a wave interface surface which is planar.

20. The method of claim 13, wherein said photonic bandgap material has a concave wave interface surface.

* * * * *